US006415715B1

(12) United States Patent
Nilsson et al.

(10) Patent No.: US 6,415,715 B1
(45) Date of Patent: Jul. 9, 2002

(54) METHOD FOR INITIATING ARTILLERY PROPELLANT POWDER CHARGES, ARTILLERY PROPELLANT POWDER CHARGE MODULE AND ARTILLERY PROPELLANT POWDER CHARGE

(75) Inventors: Neile Nilsson, Karlskoga; Larseric Larsson, Degerfors; Anders Hafstrand, Karlskoga, all of (SE)

(73) Assignee: Bofors Weapon Systems AB, Karlskoga (SE)

( * ) Notice: Subject to any disclaimer, the term of this patent is extended or adjusted under 35 U.S.C. 154(b) by 0 days.

(21) Appl. No.: 09/622,402

(22) PCT Filed: Nov. 3, 1999

(86) PCT No.: PCT/SE99/01971

§ 371 (c)(1),
(2), (4) Date: Oct. 4, 2000

(87) PCT Pub. No.: WO00/37879

PCT Pub. Date: Jun. 29, 2000

(30) Foreign Application Priority Data

Dec. 18, 1998 (SE) ..... 9804400

(51) Int. Cl.[7] ..... F12B 5/18; C06D 5/06

(52) U.S. Cl. ..... 102/288; 102/201; 102/431; 102/530

(58) Field of Search ..... 102/201, 288, 102/431, 530

(56) References Cited

U.S. PATENT DOCUMENTS

| | | | | |
|---|---|---|---|---|
| 4,474,715 A | * | 10/1984 | Weber et al. | 102/288 X |
| 4,702,167 A | | 10/1987 | Reinelt et al. | 102/282 |
| 4,864,932 A | | 9/1989 | Reinelt et al. | 102/282 |
| 4,922,823 A | | 5/1990 | Rahnenfuhrer et al. | 102/288 |
| 5,212,339 A | * | 5/1993 | Piltch | 102/201 X |
| 5,269,224 A | | 12/1993 | Gonzales et al. | 102/288 |
| 5,282,423 A | | 2/1994 | Sikorski et al. | 102/431 |
| 5,578,787 A | | 11/1996 | Kobari et al. | 102/288 |
| 5,730,462 A | * | 3/1998 | Jackson et al. | 102/530 X |
| 5,747,723 A | | 5/1998 | Buckalew et al. | 102/282 |
| 5,756,924 A | * | 5/1998 | Early | 102/201 |
| 6,209,460 B1 | * | 4/2001 | Isle et al. | 102/288 X |
| 6,343,552 B1 | * | 2/2002 | Harris | 102/431 X |

FOREIGN PATENT DOCUMENTS

| | | |
|---|---|---|
| EP | 0 718 591 A2 | 9/1997 |
| GB | 2 160 625 A | 12/1985 |
| GB | 2 259 753 A | 3/1993 |
| WO | WO 89/04453 | 5/1989 |

* cited by examiner

*Primary Examiner*—Peter A. Nelson
(74) *Attorney, Agent, or Firm*—Connolly Bove Lodge & Hutz

(57) ABSTRACT

The present invention relates to a method for avoiding uneven ignition when initiating artillery propellant powder charges (1) which comprise a plurality of partial charges of the so-called modular type and which are initiated by means of laser initiation systems or conventional ignition cartridges. The invention also includes artillery propellant powder charge modules designed in accordance with this method. The invention is also based on the fact that each such charge module or modular charge has on the one hand been provided with an initiating charge (18, 19) at each end of the central ignition channel (11), where this initiating charge can consist for example of black powder, and, on the other hand, the middle part of the same ignition channel has been provided with a specially designed firing unit (14) consisting of a number of ring elements between which narrow ignition gaps (17) are maintained.

6 Claims, 2 Drawing Sheets

Figure 2:
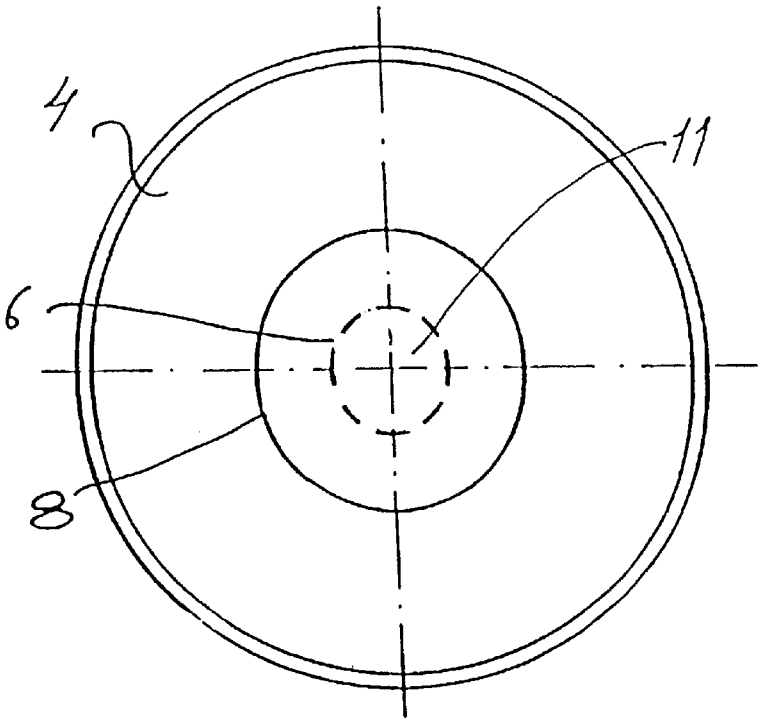

METHOD FOR INITIATING ARTILLERY PROPELLANT POWDER CHARGES, ARTILLERY PROPELLANT POWDER CHARGE MODULE AND ARTILLERY PROPELLANT POWDER CHARGE

The present invention relates to a method used mainly for laser-initiated artillery propellant powder charges consisting of a plurality of propellant charge modules arranged one after another, of the so-called modular charge type, and for obtaining an even flash-over ignition of all the propellant charge modules included in the charge, in order thereby to eliminate the risks of uneven initiation and the occurrence of pendulum pressure. The invention also includes propellant charge modules and complete charges designed in accordance with the said method.

The type of propellant charge module in question here, so-called modular charges, consists very generally of a predetermined amount of propellant powder enclosed in a preferably rigid cylindrical container which is made of a combustible material and which is outwardly delimited by an outer cylinder wall adapted to the calibre dimensions of the artillery gun in question, two essentially plane and parallel gable walls defining its ends, and a centrally arranged inner cylinder wall which extends axially through the propellant charge module and which in turn defines a central ignition channel delimited from the propellant powder.

These modular charges are used without exception in combination in order to form propellant powder charges of a charge strength adapted to each range of fire.

A common feature of the modular charges is that they have an external diameter specific for each weapon and that they all have the previously mentioned central axial ignition channel which, when several modular charges are arranged in succession, for adaptation to a predetermined longer range of fire, will form a common and continuous ignition channel through all the modular charges included therein. By contrast, the modular charges can have different lengths and can contain different types and amounts of powder and can thereby have different charge strengths.

Among the advantages of these propellant charge modules, mention may be made of the fact that they are easy to combine into propellant charges of different charge strengths and are thus easily adapted to different ranges of fire, and, by virtue of their rigid configuration, they are easy to load automatically, which was not true of the soft, so-called bag charges, which they have been developed to replace.

As examples of the more general structure of the propellant charge modules of the "modular charge type" in question here, reference may be made to U.S. Pat. No. 4,702,167, U.S. Pat. No. 4,864,932, U.S. Pat. No. 4,922,823 and WO 89/04453 where variations of these are described.

The most acute problem with artillery guns charged with modular charges has been found to be that it can be difficult to prevent initiation of the various modular parts of the charge being uneven when the piece is fired. This is because the initiation has to spread along the whole combined ignition channel of the charge where the different outer delimiting walls of the modular charges and the propellant charge powder in each modular charge for technical reasons will have slightly different burning characteristics.

The problem is well known within the sector and various proposals have previously been made for modular charges provided with specific firing charges intended to give an instant flash-over ignition alone the whole central ignition channel common to all the propellant charge modules. These previous solutions to the problem generally entail that each modular charge be provided, not just with the combustible central tube forming the central ignition channel, but also with firing charges of specially fast-burning material which bear against the inside of the central tube and are intended to spread the ignition along the whole of the continuous ignition channel of the complete charge before the respective central tube has had time to burn through. As an example of this prior art technique, reference may be made to U.S. Pat. No. 4,702,167, according to which the ignition channel of the modular charge is filled with a large number of special annular firing charges arranged in close succession. Another variant on the same theme is described in EP-0718591, although this proposes that the firing charge consists of several different layers of pyrotechnic material with different pore structures, the pores becoming ever closer towards the inner tube.

Finally, SE-9702949-0 describes a firing charge consisting of a limited number of annular firing charges concentrated in the central part of the ignition channel of each modular charge, where each firing charge ring has, alone at least one gable end directed towards the adjacent firing charge, a number of bosses or nibs which give rise to a narrow ignition gap between the different firing charge rings.

A problem which has hitherto been discussed very little in the context of modular charges is the difficulty in using laser to initiate this type of charge. It has in fact been found that laser initiation is even more locally limited than the result of conventional ignition cartridges, and laser initiation has therefore a greater tendency to give rise to uneven initiation. By contrast, general use of laser for initiation of the propellant powder charges in an artillery system should automatically entail that one is no longer dependent on special ignition cartridges, since the laser initiation system is in such cases incorporated in the actual artillery gun. Provided that the problem of uneven initiation can be solved, the laser initiation technique should therefore offer many advantages both as regards logistics and the speed with which the artillery gun in question will be able to be made ready for the next firing. At the same time, the modular charges adapted for laser initiation will also be able to be used without any disadvantage in those artillery guns where use is made of a conventional firing by ignition cartridge.

The object of the present invention is now to propose a method for obtaining an even flash-over ignition within and between standard modular charges which are designed such that the result is equally advantageous regardless of whether the initiation is done by laser or ignition cartridge. The invention also includes modular charges designed in accordance with this method, and complete artillery powder charges made up of these modular charges.

The problem which it has been possible to solve with the present invention is, as has already been stated, that of being able to eliminate the tendencies towards even initiation of propellant powder, primarily in those propellant powder charges which consist of a plurality of unit charges enclosed in combustible casings arranged one after another in a row and of the type which are usually called modular charges and which are fired using a laser initiation system, even though they are also suitable for initiation by conventional ignition cartridges.

The present invention can therefore be said, in summary, to consist of a method for initiating propellant charge modules for artillery guns comprising a predetermined amount of propellant powder enclosed in a preferably rigid cylindrical container which is made of a combustible material and is outwardly delimited by an outer cylinder wall adapted to the calibre dimensions of the intended artillery gun, two essentially plane gable walls defining its ends, and a centrally arranged inner cylinder wall which extends axially through the propellant charge module and which there forms a relay ignition channel. A characteristic feature of the invention is that there is arranged inside the relay ignition channel, in its central part as seen in the longitudinal direction, and at equal distance from the ends of the charge, a firing charge in the form of a number of firing charge rings which are arranged one after another in succession and bear against each other and whose outer dimensions match the inner dimensions of the relay ignition channel, and whose inner dimensions form a common inner ignition channel. At their gable ends facing each other, these firing charge rings are provided with spacing members in the form of studs, nibs or radial waves made in one piece with, and of the same material as, the firing charge rings. The spacing members in turn give rise to narrow ignition gaps of preferably 0.5–2 mm between the different firing charge rings. These firing charge rings with ignition gaps arranged between them have the task of ensuring an extremely fast burn-through of the material constituting the wall of the ignition channel and thus also ignition of the propellant powder included in the charge. With this type of firing charge, it is possible to ensure that the firing of the propellant powder in the main charge always takes place via the central channel, which in turn makes it possible to use the same charges in similar guns, even if these have slightly different chamber sizes. The initiation takes place so quickly that a flash-over ignition from outside never has time to take place, even if there is a sufficient gap between the chamber wall and the propellant charge for this to be able to take place in theory. To afford satisfactory functioning even in artillery guns intended for long ranges, in which there are many charge modules per charge and primarily where these are provided with laser firing systems, it has however been found that it is also necessary to take other measures which, according to the present invention, means that each charge module at respective ends of the relay ignition channel is provided with special initiating charges which guarantee a flash-over ignition between the charge modules and an ignition of the firing charges. These initiating charges must in this case consist of an easily combustible pyrotechnic substance, and as such we prefer those in which the main component is black powder.

According to one variant of the invention, the cylinder wall which forms the relay ignition channel and which delimits the space intended for the actual propellant powder charge from the central relay ignition channel is provided with a number of through-slots or holes for accelerating the actual burn-through.

In addition, this cylinder wall will preferably consist of at least 70% nitrocellulose while the firing charge, i.e the firing rings, and the alternative firing pill will preferably consist of a pyrotechnic composition produced by wet mixing and including 60–70% potassium nitrate, 20–30% boron and 10–15% zinc stearate and finally 4–10% of an acrylic binder.

Figure 1:
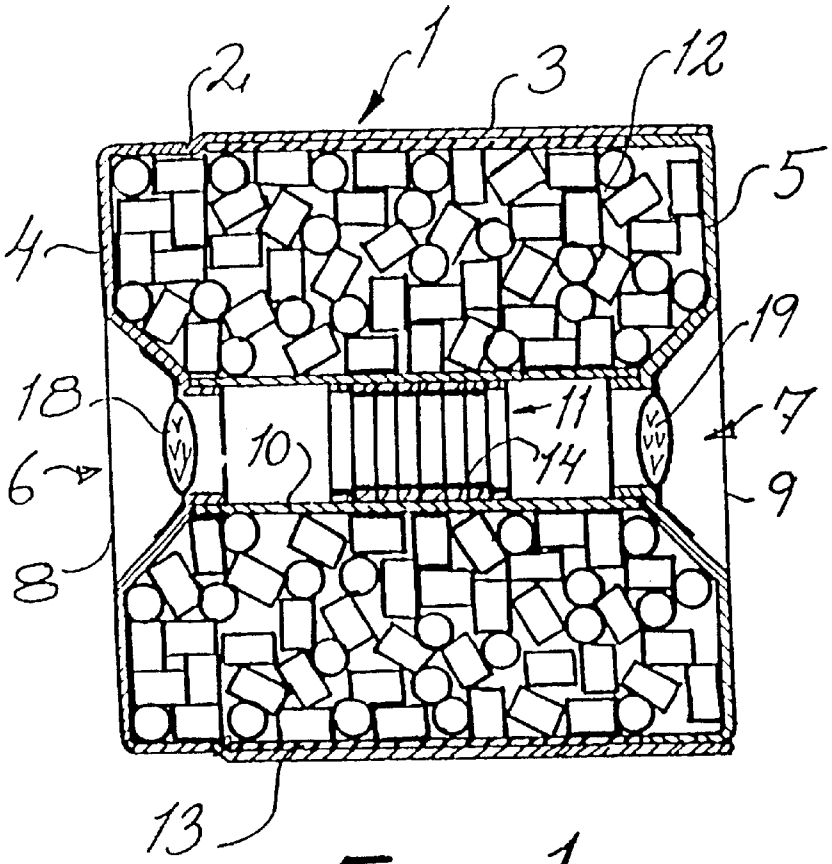
Figure 3:
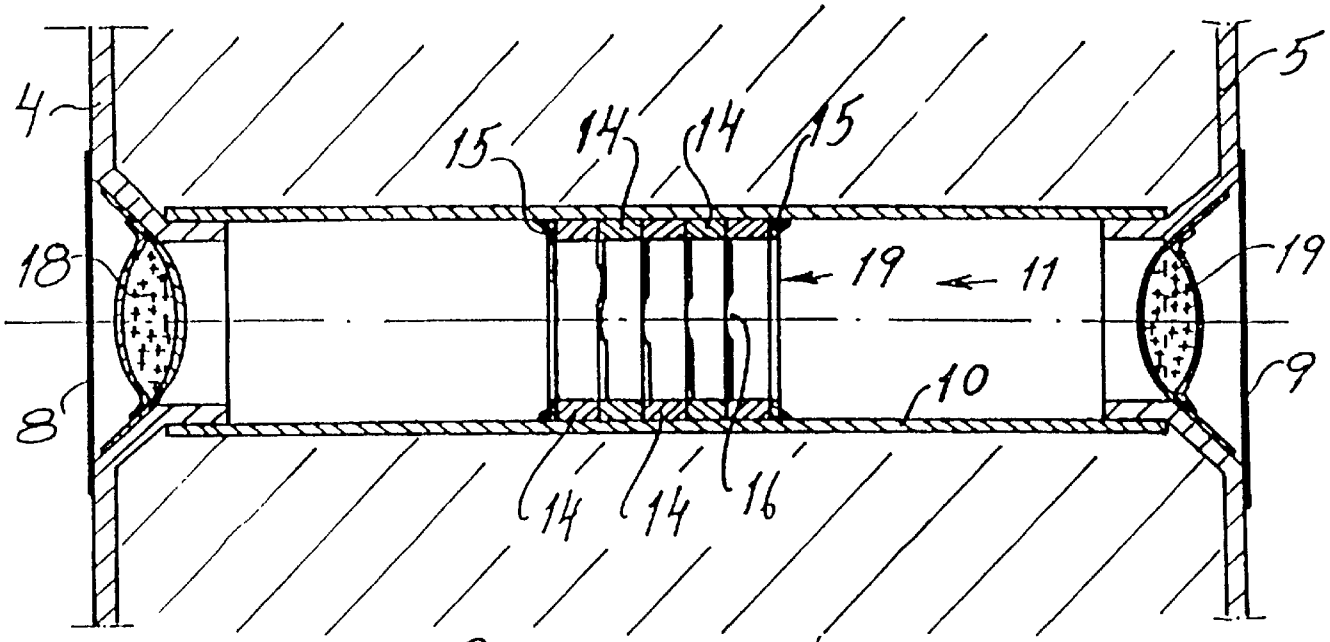
Figure 4:
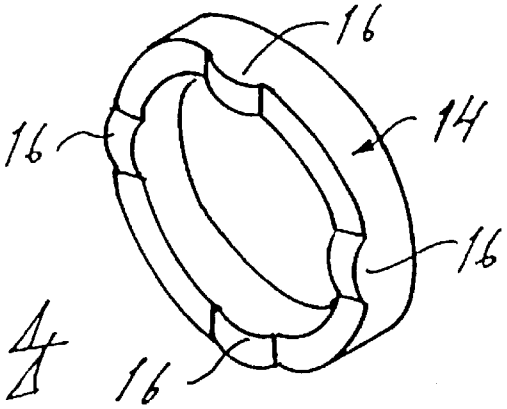

The invention is defined in a greater detail in the attached patent claims and it will now be described in more detail with reference to the attached figures, in which:

FIG. 1 shows a longitudinal section through a propellant charge module of the type in question here, FIG. 2 shows an end projection of the same propellant charge module, FIG. 3 shows a longitudinal section, on a larger scale, of the relay ignition channel with associated details, FIG. 4 shows an oblique projection of one of the firing rings included in the firing charge.

The various figures are drawn on different scales, partly for reasons of clarity, but where the same details appear in several figures, these have been given the same reference numbers in all of these figures.

The complete propellant charge module, collectively designated by 1, comprises a combustible two-part outer casing in the form of a main part 2, including a cylindrical outer wall 3 and a more or less plane gable wall 4 formed in one piece with the latter, as well as a second cover part 5 designed as a second gable wall. Ignition channel openings 6 and 7 are arranged in the centres of the gable walls 4 and 5, respectively. In the example shown, the ignition channel openings are slightly conical and they are covered by easily burned-through protective foils 8 and 9, respectively. Running between the ignition channel openings 6 and 7 there is a preferably cylindrical relay tube 10 whose interior, forms an ignition channel 11 running through the entire propellant charge module. The space between the outer wall, the gable walls and the relay tube is filled with a preferably multiply granulated artillery propellant powder 12. The relay tube 10, which can or the most part consist, for example, or nitrocellulose, has the purpose, as soon as it has burned through to the artillery propellant powder 12, of spreading an initiation effected inside the ignition channel 11. Anti-wear agents, for example of the Swedish Additive Type, and flame dampers or other additives can be arranged along the inside of the outer wall 3. In FIG. 1, these additives have been designated collectively by 13.

The initiating system which characterizes the invention includes a number of firing rings 14 made of pyrotechnic material which are arranged inside the relay ignition channel 11. These are held in place inside the relay ignition channel 11 by combustible gable rings 15, which, for example, can be glued in place. The empty central portions of the firing rings together form an inner initiating channel 19. A distinguishing feature of these firing rings is also that these have, at least at one gable end, spacing members 16 in the form of nibs, bosses or wave formations in their own end surface. These spacing members, which are preferably made in one piece with, and of the same material as, the rest of the firing rings, have the object of ensuring that there are flash-over gaps 17 between the firing rings 14. This is to accelerate the flash-over of the actual propellant charge and thereby eliminate the risks of uneven initiation and the associated pendulum pressure in the launching barrel in connection with firing.

The initiating charges 18 and 19 characterizing the invention are also arranged in the gable ends of the relay channel 11. In the example shown, each one of these consists of a small amount of encapsulated black powder.

When one or more of the specific modular charges characterizing the invention have been charged in the artillery gun in question and the piece has been fired, the initiating system, which for example can be a laser firing arrangement, will initiate the initiating charge of the first module which in turn will ignite the firing charge rings of the module and the initiating charge in the other end of the module which thus in turn guarantees that the ignition is spread at the greatest possible speed, while at the same time the firing charge of the module ignites the powder in the main charge.

What is claimed is:

1. Method for obtaining an even initiation, both with laser and conventional ignition cartridges, of artillery propellant powder charge modules (1) which consist of a combustible outer casing filled with loose or packed artillery powder (12) and adapted to the calibre of the respective artillery gun, in the form of a cylinder (3), two plane gable walls (4, 5) more or less parallel to each other and connected to the respective ends of the side wall part, and a cylindrical relay tube (10) which is centrally arranged between the gable walls and which forms an open ignition channel (11) running through the propellant powder charge module from the gable ends, characterized in that the initiation of the propellant powder charge module, which is thus carried out by igniting an easily ignitable first initiating charge (18) arranged towards the mouth in the direction from which the initiation takes place, while the initiation of the next propellant powder charge module in the initiation direction is carried out by ignition of a second initiating charge (19) which is arranged at the other end of the ignition channel and which in turn spreads the ignition to the adjoining initiating charge (18) in the next propellant powder charge module while the flash-over ignition of the actual propellant powder included in the propellant powder charge module is initiated by the said first initiating charge (18) igniting a number of annular firing charges (14) which are arranged in the central part of the ignition channel are made of a more easily ignitable and faster-burning material than the actual tubular wall (10) of the igniting channel (11), and between which firing charges (14) narrow ignition gaps (17) have been maintained.

2. Artillery propellant powder charge module (1) designed for initiation both with laser and conventional ignition cartridges in accordance with the method according to claim 1, comprising a combustible outer casing adapted to the calibre of the artillery gun intended for this method and in the form of a cylindrical side wall part (3), two more or less parallel, plane gable parts (4, 5) connected to the respective ends of the side wall part, and a cylindrical tubular inner part (10) which is centrally arranged between the gable parts and forms an ignition channel (11) running through the propellant powder charge module, characterized in that special initiating charges (18, 19) of very easily ignitable material are arranged in the respective ends of the ignition channel, which initiating charges (18, 19) completely delimit the ignition channel (11) there, while in its middle part there are a number of annular firing charges (14) of a faster-burning and more easily combustible material than the said tubular inner part (10) and between which there are narrow ignition gaps (17).

3. Artillery propellant powder charge module according to claim 2, characterized in that each one of the annular firing charges (14) has, along at least its broad side directed towards the next firing charge, a number of bosses or nibs (16) which there gives rise to the said ignition gap (17).

4. Artillery propellant powder charge module according to claim 3, characterized in that the annular firing charges (14) are held in place in the ignition channel (11) by means of locking rings (15) glued opposite each other to the inside of the channel.

5. Artillery propellant powder charge module according to claim 3, characterized in that the main component in the initiating charges (18, 19) comprises black powder, while the annular firing charges (14) comprise a pyrotechnic composition obtained by wet mixing and comprising 60–70% potassium nitrate, 20–30% boron, 10–15% zinc stearate and 4–10% acrylic binder.

6. Artillery propellant powder charge, characterized in that it comprises a plurality of successively arranged charge modules of the type defined in claim 2, where the initiating charges facing each other in two successively arranged charge modules separated from each other only by two combustible protective foils which form part of each charge module and which protect the mouth of the respective ignition channel until initiation and combustion.

* * * * *